US008627872B2

(12) United States Patent
Wedekind

(10) Patent No.: US 8,627,872 B2
(45) Date of Patent: Jan. 14, 2014

(54) GARAGE DOOR WITH REINFORCING TRUNCATED ISOSCELES STRUT CONSTRUCTION AND REINFORCING STRUT CONSTRUCTION

(75) Inventor: Gary A. Wedekind, Dixon, IL (US)

(73) Assignee: Raynor MFG., Co., Dixon, IL (US)

( * ) Notice: Subject to any disclaimer, the term of this patent is extended or adjusted under 35 U.S.C. 154(b) by 244 days.

(21) Appl. No.: 12/943,561

(22) Filed: Nov. 10, 2010

(65) Prior Publication Data

US 2012/0111508 A1 May 10, 2012

(51) Int. Cl.
*E06B 3/48* (2006.01)
*E06B 7/086* (2006.01)
*E05D 15/00* (2006.01)

(52) U.S. Cl.
USPC ..... 160/229.1; 160/201

(58) Field of Classification Search
USPC ..... 160/207, 209, 229.1, 201; 52/236.3, 52/264, 291, 506.07, 734.1, 739.1
See application file for complete search history.

(56) References Cited

U.S. PATENT DOCUMENTS

| | | | |
|---|---|---|---|
| 2,196,399 | A | 4/1940 | Rubel |
| 2,525,309 | A | 10/1950 | Norberg |
| 2,863,503 | A | 12/1958 | Stroup |
| 2,966,212 | A | 12/1960 | Fimbel, Jr. |
| 3,010,547 | A | 11/1961 | Foster |
| 3,180,460 | A | 4/1965 | Liskey, Jr. |
| 3,376,913 | A | 4/1968 | Clapsaddle |
| 3,443,625 | A | 5/1969 | Moser et al. |
| 3,516,474 | A | 6/1970 | Pemberton et al. |
| 3,608,613 | A | 9/1971 | Halliwell |
| 3,740,916 | A | 6/1973 | Kenaga |
| 3,891,021 | A | 6/1975 | Geoffrey |
| 3,910,003 | A | 10/1975 | Jerila |
| 3,941,180 | A | 3/1976 | Thill |
| 3,967,761 | A | 7/1976 | Melton, Jr. et al. |
| 4,156,448 | A | 5/1979 | Bengtsson |
| 4,284,119 | A | 8/1981 | Martin et al. |
| 4,378,043 | A | 3/1983 | Sorenson |
| 4,385,476 | A | 5/1983 | Slager |
| 4,644,725 | A | 2/1987 | Schijf |
| 4,893,666 | A | 1/1990 | Hormann |
| 4,934,439 | A | 6/1990 | Martin |
| 4,982,545 | A | 1/1991 | Stromback |
| 5,002,114 | A | 3/1991 | Hormann |
| 5,129,441 | A | 7/1992 | Leist et al. |
| 5,148,850 | A | 9/1992 | Urbanick |
| 5,170,832 | A | 12/1992 | Wagner |
| 5,188,163 | A | 2/1993 | Schwartzengraber et al. |
| 5,235,724 | A | 8/1993 | Perrin et al. |

(Continued)

OTHER PUBLICATIONS

Raynor U-bar punching layout, Feb. 28, 2005, p. 1.

(Continued)

*Primary Examiner* — Katherine Mitchell
*Assistant Examiner* — Jeremy Ramsey
(74) *Attorney, Agent, or Firm* — Banner & Witcoff, Ltd

(57) ABSTRACT

A door strut construction includes a strut having a top cross wall connecting lateral side walls that are part of a truncated isosceles triangle and wherein the lateral cross wall joins first and second spaced pylons attached to the top edge of the side walls and further wherein the bottom edge of the side walls include projecting plate members having upstanding, outside lips for reinforcement. The strut further includes lateral ribs positioned in the upper half region of the side walls to improve torsion resistance.

2 Claims, 4 Drawing Sheets

(56) References Cited

U.S. PATENT DOCUMENTS

| | | | | | |
|---|---|---|---|---|---|
| 5,359,812 | A | | 11/1994 | Mayfield | |
| 5,588,270 | A | | 12/1996 | Keating | |
| 5,749,407 | A | | 5/1998 | Brenner et al. | |
| 5,782,283 | A | | 7/1998 | Kendall | |
| 6,041,478 | A | | 3/2000 | Martin | |
| 6,062,293 | A | * | 5/2000 | Berger, Jr. | 160/229.1 |
| 6,082,429 | A | | 7/2000 | Ochoa | |
| 6,161,606 | A | * | 12/2000 | Wegner et al. | 160/229.1 |
| 6,250,361 | B1 | | 6/2001 | Ochoa | |
| 6,330,901 | B1 | | 12/2001 | Friesen et al. | |
| 6,408,926 | B1 | | 6/2002 | Hoofard et al. | |
| 6,527,036 | B1 | | 3/2003 | Welsh | |
| 6,578,619 | B2 | | 6/2003 | Wright | |
| 6,629,387 | B2 | | 10/2003 | Whitley et al. | |
| 6,772,818 | B2 | | 8/2004 | Whitley et al. | |

OTHER PUBLICATIONS

Chi, Chi drawing: Z6-1808-66100, Sep. 22, 2008, pp. 1-2.
Minnesota Metals, Inc., Minnesota Metals, p. 1, 2009.
Richards-Wilcox, Linear Face Hardware—Tuss Profiles, Sep. 20, 2005, p. 1.
Martin Finger Shield TM Garage Door, Woodline Series with Windows—16' wide—large Missile Impact Resistant—Nov. 5, 2008, pp. 1-6.
Overhead Door, Windload, Banner 15.2/-20.5 PSF Design 18' Max Wide, Dec. 22, 2008, pp. 1-2.
Overhead Door, Windload, Banner 20.2/-22.5 PSF Design 18'-0" max, Dec. 22, 2008, pp. 1-3.
Arrow Tru-Line, Inc., CEE Channel & Struts, pp. 1-14, 2009.
Windsor Republic Doors, Windload Residential Steel Door for IBC/FBC/IRC 130/140 MPH. Exposure "C", Oct. 15, 2007, pp. 1-2.
Amarr, Model #650 Oak Summit Series 1000 & 2000; Model #600 Stratford Series 1000 & 2000; Model #950 Heritage Series 1000 & 2000, Mar. 18, 2010, pp. 1-2.
Horman LLC, Hurricane Door 16'x7', Apr. 9, 2009, pp. 1-3.
Mid-America Door Company, Windload Construction Details, Apr. 28, 2010, pp. 1-2.
Clopay Building Products Company, 2-IN PAN +42/−48 16-2 × 16-0, Nov. 21, 1994, p. 1.
doorLink Manufacturing, Inc., Windload Rated Residential Garage Door Models 510, 410, 430, 450, 470, Jul. 24, 2007, pp. 1-2.
DAB Door Company, Inc., 18'-2" Wide. 16' High Steel Sectional Garage Door with Window Lite Option, Mar. 18, 2009, pp. 1-8.
South Florida Building Codes for Garage Doors, by Danielle Hill, eHow Contributor, Aug. 10, 2010, pp. 1-3.
Factors to Consider When Choosing a Reinforced Garage Door, www.clopaydoor.com/wind-code0winload.aspx, Sep. 9, 2010, pp. 1-3.
Florida Building Code, www.floridabuilding.org, 2008, pp. 1-5.

* cited by examiner 20
22
24
32
34
36
38
40
42
48
50
52
54
56
58
60
62
64
66

GARAGE DOOR WITH REINFORCING TRUNCATED ISOSCELES STRUT CONSTRUCTION AND REINFORCING STRUT CONSTRUCTION

BACKGROUND OF THE INVENTION

In a principal aspect the present invention relates to a strut for use in combination with a door panel such as with the panel of a multi-panel folding garage door.

Folding garage doors are typically constructed from a plurality of generally rectangular panels which are hinged so that they articulate with respect to one another as they are moved between a door closed and a door open position. The door panels are generally mounted on tracks positioned on opposite sides of the door opening. The tracks extend upwardly and inwardly into the interior of the garage enclosure. Thus the door panels may be attached by means of rollers to the tracks so that the door may be raised or lowered. As the door is raised or lowered, the panels articulate one with respect to the other and follow the tracks between the closed position and the open position.

In certain geographical regions, particularly in regions where environmental conditions demand, doors are required pursuant to building codes to withstand significant forces. For example, in Florida where hurricanes are prevalent, garage doors as well as other doors for enclosures are required to meet certain building code wind resistance standards in order to qualify for installation in buildings. The standards typically require that garage doors withstand wind gusts in excess of 100 mph. State and local agencies often require testing to verify compliance with building code standards. The State of Florida code is an example and a discussion of the applicable codes for garage doors in South Florida can be found at http://www.ehow.com/list_6828855_south-building-codes-garage-doors.html#ixzz0z53VQd6q which is incorporated herein by reference.

A means for providing a garage door that meets building code standards is to provide reinforcements for the door panels. Such reinforcements may comprise struts or trusses which are attached to the inside face of the door panels. The placement, design and number of such reinforcing elements may vary. However, a uniform objective is to provide means for enhancing the structural integrity of such doors.

Heretofore, various patents have been granted which disclose construction reinforcement techniques such as struts for the purpose of reinforcing folding panels including the following: U.S. Pat. No. 5,749,407 entitled "Folding Garage Door With Reinforcing Struts", issued on May 12, 1998; U.S. Pat. No. 2,196,399 entitled "Switchboard Construction", issued on Apr. 9, 1940; U.S. Pat. No. 2,863,503 entitled "Sectional Door of the Vertically Opening Horizontally Hinged Type", issued on Dec. 9, 1958; U.S. Pat. No. 2,966,212 entitled "Extra Wide Vertically Sliding Doors", issued on Dec. 27, 1960; U.S. Pat. No. 3,010,547 entitled "Prefabricated Building", issued on Nov. 28, 1961; U.S. Pat. No. 3,180,460 entitled "Floor Panel for Elevated Flooring", issued on Apr. 27, 1965; U.S. Pat. No. 3,443,625 entitled "Reinforced Collapsible Door", issued on May 13, 1969; U.S. Pat. No. 3,516,474 entitled "Door Brace Structure", issued on Jun. 23, 1970; U.S. Pat. No. 3,608,613 entitled "Sliding Door", issued on Sep. 28, 1971; U.S. Pat. No. 3,740,916 entitled "Panel Construction", issued on Jun. 26, 1973; U.S. Pat. No. 3,891,021 entitled "Garage Door with Rolled Overlapping Joint for Adjacent Panels", issued on Jun. 24, 1975; U.S. Pat. No. 3,910,003 entitled "Door Stiffener", issued Oct. 7, 1975; U.S. Pat. No. 4,378,043 entitled Pivoting Screen Panel for Sectional Garage Door, issued Mar. 29, 1983; U.S. Pat. No. 4,385,476 entitled "Web Stiffener for Light-Gauge Metal Framing Members", issued on May 31, 1983; U.S. Pat. No. 4,934,439 entitled "Tension Strut Apparatus and Method for an Overhead Garage Door", issued on Jun. 19, 1990; U.S. Pat. No. 4,982,545 entitled "Economical Steel Roof Truss", issued on Jan. 8, 1991 and U.S. Pat. No. 5,588,270 entitled "Garage Door Brace", issued Dec. 31, 1996.

The utilization of struts of the type disclosed in the above-identified references and otherwise available in the marketplace accomplishes the function of enhancing the structural integrity of door panels. Nonetheless there has remained a need to provide improved struts and strut constructions which meet a number of criteria. First, the amount of material allocated to the strut should be minimized in order to reduce the weight of the reinforcing strut. Second, such struts should be resistant to tensile as well as torsional forces. Third such struts should be easily incorporated with existing folding door panel constructions. Fourth such struts should be inexpensive, easy to install, easy to replace and compact in order to avoid misuse of space within the interior of a building enclosure due to unnecessary intrusion of the reinforcing strut construction. Fifth, such struts should enable doors and door panels to meet or exceed code requirements.

These and other objects, advantages and features comprise incentives for the development of the present invention.

SUMMARY OF THE INVENTION

Briefly the present invention comprises a strut for reinforcement of panels such as folding garage door panels. The strut is configured to be applied or fastened to the inside surface or face of such a door panel. The purpose of the strut is to reinforce the door panels and thus the door to effectively resist the forces of environmental occurrences such as hurricanes.

The strut is typically made from sheet metal in the form of an elongate beam comprised of a top wall joined to opposed, spaced side walls with a medial plane of symmetry defined between the side walls. The strut structure is thus substantially identical in form on the opposite sides of the plane of symmetry. Each side wall includes a longitudinal rib. The side walls diverge from each other and constitute truncated sections an isosceles triangle having an included angle of divergence in the range of about 5 to 15°. The top part or edges of the truncated wall sections are connected by a cross wall that includes longitudinal spaced pylons positioned at the top edge of each of the diverging side walls. The two pylons are joined by a flat, planar, cross wall section transverse to the medial plane of symmetry.

The bottom edge of each of the side walls connects to a flat planar plate member extending outwardly therefrom with an upwardly extending, outer lip. Each flat planar side plate member forms an angle in the range of about 80 to 87°±1° with respect to the respective connected side wall member. The upwardly extending, outer lip on the outer edge of each of the planar plate members forms an obtuse angle with the respective plate member. The plane of the plate members between the bottom edges of each side wall constitutes the third side of a truncated, isosceles triangle defined by the side walls. Dimensional relationships and characteristics are disclosed which enable that the strut to provide improved resistance to forces resulting from, for example, environmental forces on a door panel and/or door to which the strut is attached.

A longitudinal, auxiliary truss may be fastened to the cross wall section between the pylons. The truss is typically symmetrical in cross section about the plane of symmetry.

Thus, it is an object of the invention to provide an improved strut construction for attachment to a panel such as a garage door panel of a folding garage door.

A further object of the invention is to provide a strut construction mounted on a panel which provides deformation resistance to wind and other forces by virtue of a design which enjoys significant structural integrity relative to various known strut constructions.

Another object of the invention is to provide a strut which is easy to manufacture, easy to incorporate or combine with existing garage door panel designs, inexpensive and compact yet adequately strong.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF EMBODIMENTS OF THE INVENTION

Figure 6:
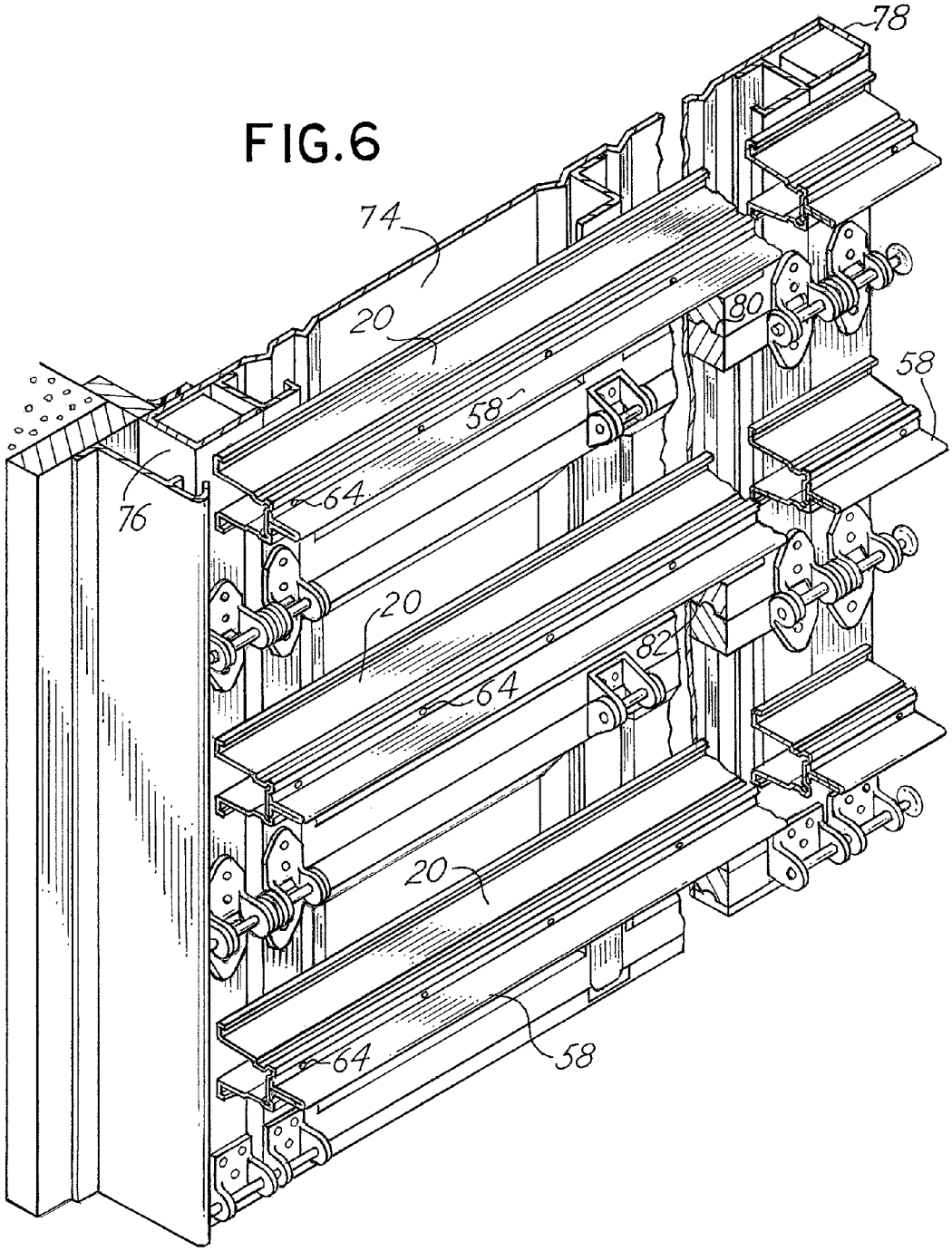
FIG. 6 is an isometric view of a strut of the invention in combination with a U-bar truss as attached to a panel such as a garage door panel in an isometric view.

FIGS. 1-4 illustrate an embodiment of a strut of the invention which is made for attachment to a door panel such as a garage door panel in the manner illustrated in FIG. 6. FIG. 5 depicts the strut of FIGS. 1-4 in combination with an optional truss attached to or mounted upon the strut of FIGS. 1-4.

Referring to FIGS. 1-4, a strut 20 is typically fabricated from a uniformly thick material such as sheet metal material, for example, an 18 or 20 gauge, galvanized sheet steel. The strut 20 may be formed from a flat elongate sheet of such material by a roll forming process. Materials other than galvanized steel sheet may be utilized and other techniques may be utilized to manufacture a strut representative of the invention. Such materials may include polycarbonate, molded carbon fibre sheet materials and the like.

Figure 3:
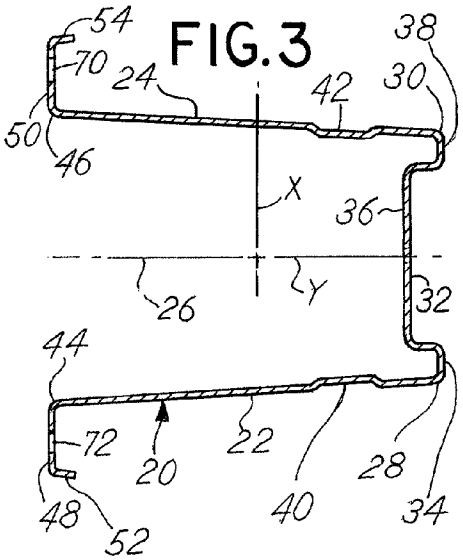
FIG. 3 is a cross sectional view taken along the line 3-3 in FIG. 1.
Figures 4, 5:
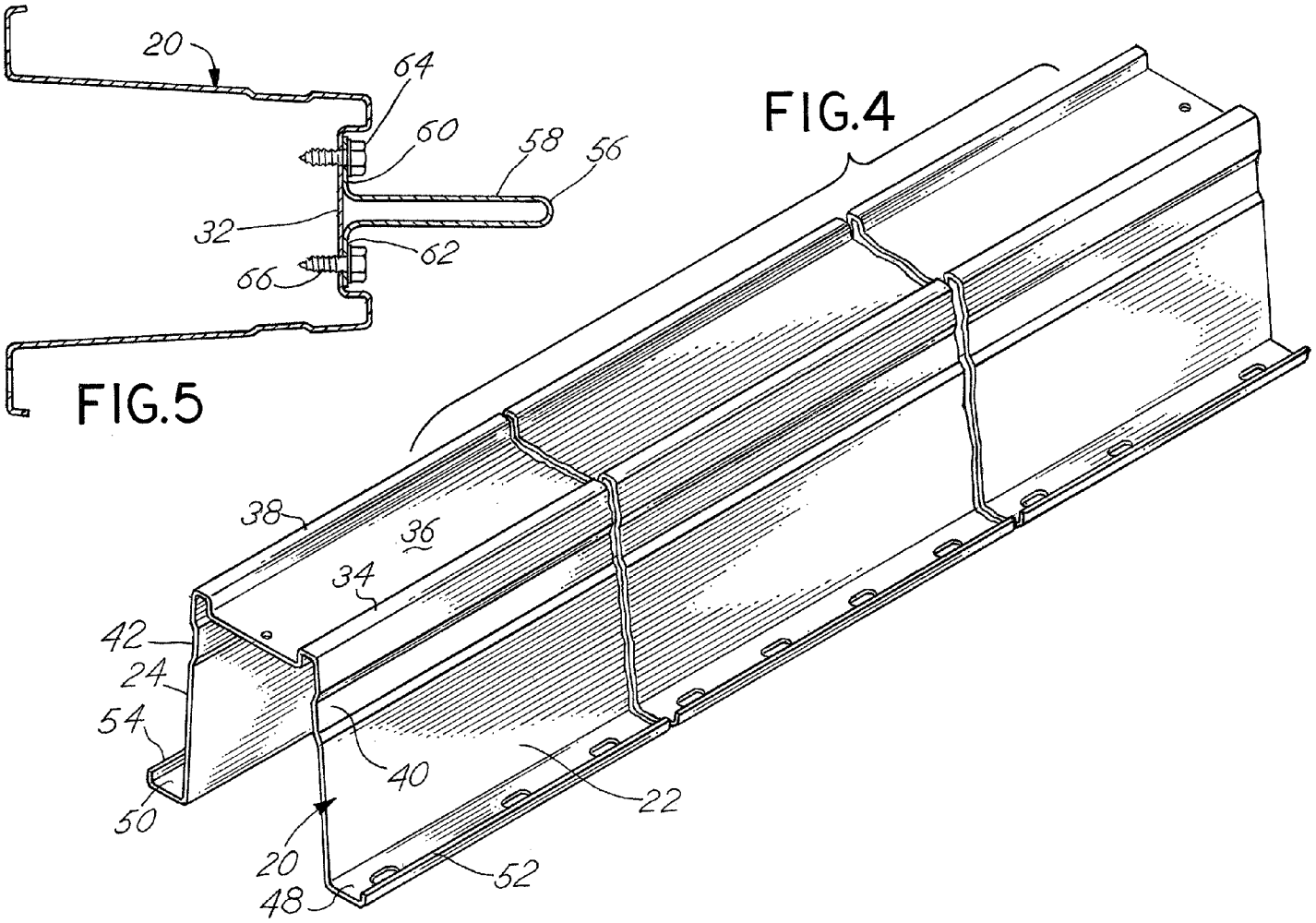
FIG. 4 is a isometric view of the strut of FIG. 1.
FIG. 5 is a cross sectional view of an alternative embodiment of the invention wherein the strut of FIG. 1 is combined with a U-bar truss.

Typically strut 20 as depicted in FIGS. 1-4 as well as a combination strut and truss, such as depicted in FIG. 5, will be used for reinforcement of panels such as folding garage door panels. The strut 20, as depicted in FIGS. 1-4, as well as a strut 20 and truss 56 as depicted in FIG. 5 are typically attached to the inside face or surface of a garage door panel to reinforce panel resistance to deformation due to strong winds and other environmental conditions. Thus typical usage would be in association with reinforcement of multi-panel, folding garage doors which, in many geographical jurisdictions, are required to be resistant to high wind due to hurricanes and similar weather phenomenon. Many building codes adopted by municipalities and states require that such panels meet minimum wind resistant standards. The state of Florida promulgates such regulations and the strut and the combination of a strut and panel of the type disclosed herein are designed to meet or exceed such standards.

The strut 20 has a uniform cross section, for example, as depicted in FIG. 3. More particularly, strut 20 includes a first side wall 22 and a second opposite side wall 24 as well as a medial plane of symmetry 26. The plane of symmetry 26 comprises a vertical plane in the drawing midway between the first and second side walls 22 and 24. The first side wall 22 includes a top edge 28. The second side wall 24 includes a top edge 30. The top edge 28 of the first side wall 22 is joined to the top edge 30 of the second side wall 24 by a cross wall 32. Cross wall 32 is integral with the first side wall 22 and is joined to the top edge 28. Cross wall 32 includes a first pylon 34 connected by a flat planar intermediate cross wall section 36 to a second pylon 38 integral with and connected to the second top edge 30. The first side wall 22 includes a longitudinal rib 40 which is formed therein and which is offset inwardly toward the plane of symmetry 26 by a dimension at least equal to the thickness of the material forming the strut 20. Similarly there is a symmetrical longitudinal rib 42 in the second side wall 24 parallel to the first rib 40.

The first side wall 22 and the second side wall 24 form truncated parts or sides of an isosceles triangle wherein the side walls 22 and 24 are truncated portions of the equal sides of an isosceles triangle forming an angle of divergence in the range of about at least about 5° and typically no more than about 12° to 15°. The first side wall 22 includes a first lower edge 44 laterally spaced from a second lower edge 46 of the second side wall 24. The span between the first lower edge 44 and the second lower edge 46 defines a virtual third leg of an isosceles triangle further defined by the first side wall 22 and the second side wall 24. The first lower edge 44 is joined to an outwardly extending flat planar plate member 48 which is co-planar with a second flat planar plate member 50 extending outwardly from the second lower edge 46. Each of the first and second plate members 48 and 50 include an upwardly extending outer lip; namely, first lip 52 and second lip 54 respectively. The lips 52 and 54 form an obtuse angle with the respective first plate member 48 and second plate member 50 in the range of about 95±1° in a typical strut construction.

Among the features deemed desirable with respect to the strut construction depicted are the following. First, the width of pylons 34 and 38 is substantially the same and cumulatively comprises about 25% to 40% of the width and most desirably about 35% of the spacing between the top edges 28 and 30. Second, the ribs 40 and 42 are preferably positioned inward with respect to the flat plane of planar side walls 22 and 24. Further, the ribs 40 and 42 have a dimension spaced from the respective top edges 28, 30 equal to the or nearly equal to the dimension of the width of each of the ribs 40, 42. Third, the ribs 40 and 42 are in the upper portion of the strut 20 more closely adjacent to the cross wall 32. The centroid in the X and Y planes lies on the vertical Y plane or axis of symmetry 26 approximately in the range of 35 to 45% of the distance from the top of the pylons 34 and 38. That is, the centroid is closer to the top of each of the pylons 34 and 38 than it is to each of the plate members 48 and 50. The section modulus about the y-axis is increased due to the larger moment of inertia about the y-axis which is a result of the profile of the strut. The extra width of cross wall 32 is an important reason for an improved moment of inertia about the y-axis.

Figure 1:
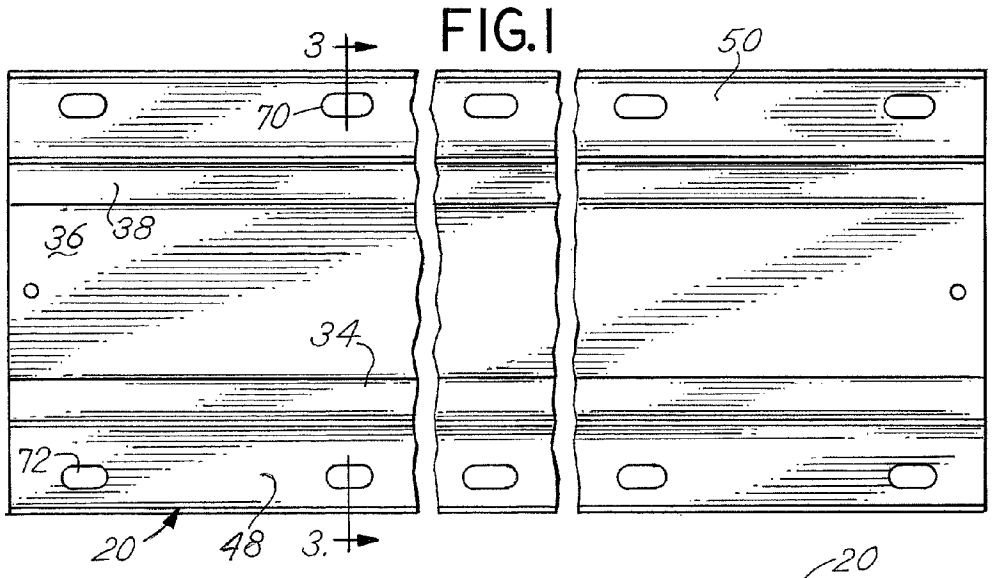
FIG. 1 is a top plan view of an embodiment of a strut of the invention.
Figure 2:
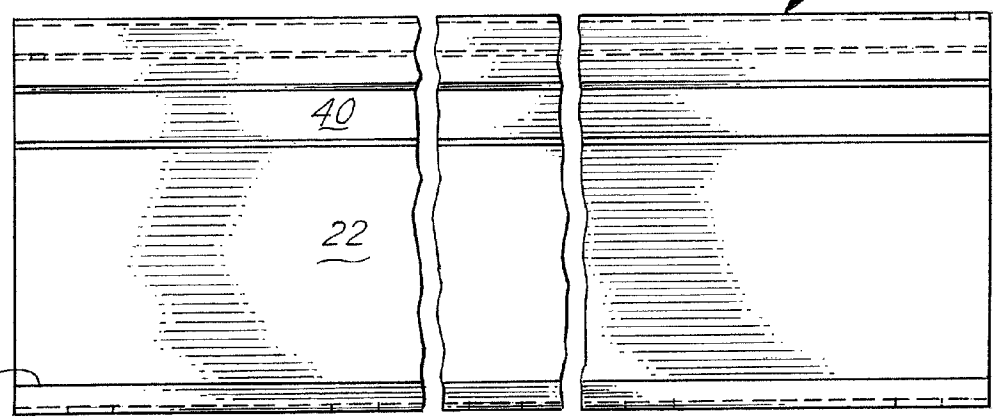
FIG. 2 is a side elevation of the strut of FIG. 1.

Fourth, the spacing of the pylons 34, 38 becomes an important feature inasmuch as it enables the utilization of an option U-bar truss 56 which may be positioned in and upon attached to the intermediate wall 36 as illustrated in FIG. 5. More specifically, the U-bar truss 56 includes a formed U-shaped reinforcing member 58 with projecting side wings 60 and 62 that may be fastened by fasteners 64 and 66 onto the intermediate wall section 36 to enhance the strength of the assembly. Referring further to FIG. 1 and FIG. 4 it will be noted that the side plate members 48 and 50 include a series of elongate fastener openings such as openings 70, 72.

Fifth, the spacing of the top edges 28 and 32 relative to the dimension of the spacing of the outside edges of lateral side plate members 48, 50 is in the range of a ratio from 1 to about 1.6. FIG. 3 sets forth nominal dimensions of a typical strut 20 which conforms with the dimensional characteristics and structural dimensions and features discussed.

Referring to FIG. 6, there is illustrated fastening of the strut 20 to a typical door panel 74 associated with an garage door. Specifically a panel such as panel 74 includes opposite lateral sides 76 and 78 as well as generally parallel top and bottom sides 80 and 82 respectively. Such a panel 74 therefore is generally rectangular in configuration. However, the use of the strut 20 of the invention is not limited to such a rectangular panel 74, it may be used in combination with other geometric shapes including trapezoidal shapes, circular shapes, square shapes and other geometrical configurations.

Typically a strut such as strut 20 in FIG. 5 is attached to the inside of a panel 74 and oriented horizontally with respect to the movement of a door panel. However, horizontal alignment is not a necessary feature of the use of the strut 20. Various orientations may be adopted while still providing enhanced rigidity and resistance to environmental forces such as wind.

The strut 20 with or without a U-bar truss 56 is generally applied or attached by fasteners to the inside or backside of panel surface of a panel 74 as depicted. Multiple parallel struts 20 of the type disclosed may be used on a single panel 74. Various patterns of struts 20 may be applied to one or more panels 74 in a multi panel door configuration. Such struts may or may not include a U-bar truss 56. One or more struts 20 may include such a U-bar truss 56. Further, the struts 20 will typically extend the entire distance intermediate and between the lateral sides 76 and 78 of a panel 74. However, the strut 20 may extend only partially over such a span of a panel 74 or may extend beyond a span distance defined by the lateral sides 76 and 78 depending upon the desires or the user of the strut 20. Such struts are generally of uniform cross-section along their length, but the cross-section may be varied in some circumstances. Struts 20 may be arranged in various angles or in a geometric configuration on a panel. The general dimensions of the strut 20 may be varied and typical dimensional characteristics of a typical strut 20 are set forth in FIG. 3.

Figure 7:
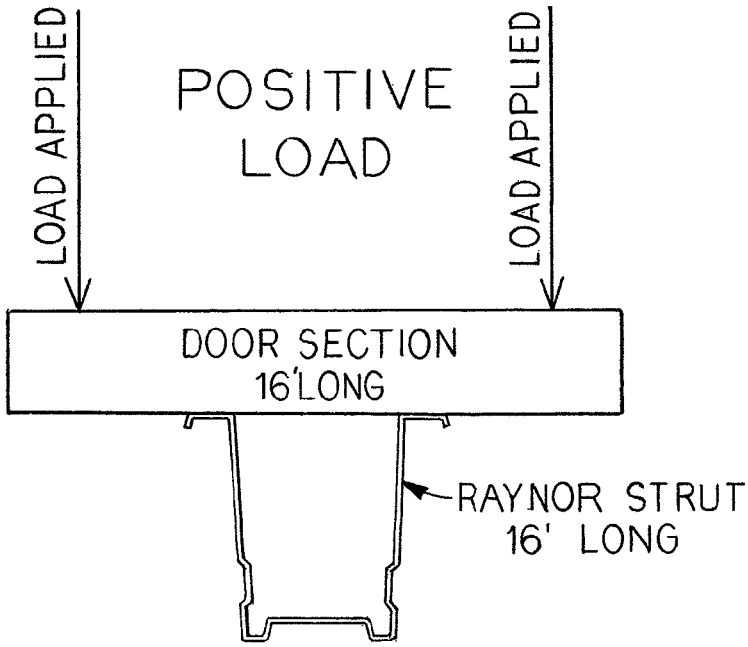
FIG. 7 is a diagrammatic view of a test arrangement employed to demonstrate the utility of the invention.
Figure 8:
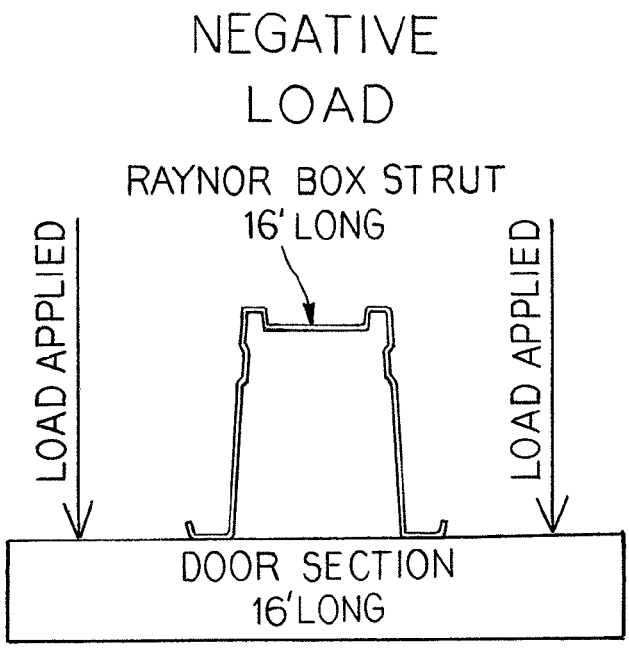
FIG. 8 is a diagrammatic view of an alternate test arrangement to demonstrate the utility of the invention.

Deflection testing of a strut 20 of the type depicted in FIG. 3 under a static load is set forth in Table 1. The testing protocol is diagrammatically depicted in FIGS. 7 and 8. A negative or positive load is placed against a reinforced panel having a 16 foot horizontal strut substantially equal to the width of the test panel.

TABLE 1

| Load in Pounds | Positive Direction Deflection in inches 18 gauge sheet | Negative direction Deflection in inches 18 gauge sheet | Positive Direction Deflection in Inches 20 gauge sheet | Negative Direction Deflection in inches 20 gauge sheet |
|---|---|---|---|---|
| 240 | | | 0.56 | |
| 320 | | | 0.75 | |
| 400 | | | 0.95 | |
| 480 | 1.03 | 0.90 | 1.15 | 1.19 |
| 560 | 1.19 | 1.07 | 1.32 | 1.39 |
| 640 | 1.35 | 1.23 | 1.54 | 1.59 |
| 720 | 1.53 | 1.39 | 1.72 | 1.81 |
| 800 | 1.67 | 1.53 | 1.93 | 2.03 |
| 880 | 1.83 | 1.67 | 2.13 | 2.25 |
| 960 | 2.01 | 1.83 | 2.26 | 2.43 |
| 1040 | 2.19 | 2.01 | 2.46 | 2.67 |
| 1120 | 2.35 | 2.19 | 2.64 | 2.88 |
| 1200 | 2.51 | 2.35 | 2.84 | 3.08 |
| 1280 | 2.67 | 2.51 | 3.06 | 3.30 |
| 1360 | 2.82 | 2.65 | 3.27 | 3.50 |
| 1440 | 2.98 | 2.79 | 3.49 | 3.72 |
| 1520 | 3.14 | 2.96 | 3.79 | 4.04 |
| 1600 | 3.32 | 3.12 | Failed | Failed |
| 1680 | 3.5 | 3.30 | | |
| 1760 | 3.68 | 3.48 | | |
| 1840 | 3.86 | 3.66 | | |
| 1940 | 4.06 | 3.90 | | |
| 2020 | 4.24 | 4.08 | | |
| 2100 | Failed | 4.28 | | |
| 2180 | | 4.48 | | |
| 2260 | | 4.69 | | |
| 2300 | | 4.79 | | |

The particular design such as depicted in FIG. 3 and tested employs the following moment of inertia in the X and Y plane:

$$Ix=1.311\ in^4$$

$$Iy=1.163\ in^4$$

The exemplary strut configuration of FIG. 3 thus provides a significant improvement with respect to section modules particularly about the X axis. The ultimate strength and character of the strut is dependent in part upon the materials utilized for the manufacture of the strut. With respect to the data provided, an 80 KSI high strength steel, either 18 gauge or 20 gauge is typical.

Variations of the invention are possible without departing from the spirit and scope thereof. For example, the strut material, the dimensional characteristics, the positioning of certain features such as the ribs 40 and 42, the number of ribs, the dimensions of the pylons, and other features may be varied without departing from the spirit and scope of the invention. Features which characterize of the strut of the invention are, in particular, the diverging side walls and the angular relationships between the various component parts of the strut. Thus, while there has been set forth a preferred embodiment of the invention, it is to be understood that the invention is limited only by the following claims and equivalents thereof.

What is claimed is:

1. In a generally rectangular door panel having an inner door side, an outer door side, and a pair of opposite lateral side edges, the improvement consisting of a reinforcing strut attached to at least one of said door sides, said strut extending at least partially intermediate said opposite side edges, said strut formed from a substantially uniform thickness, material sheet, said sheet having a longitudinal dimension, a longitudinal centerline axis and a uniform, consistent cross sectional configuration transverse to the longitudinal dimension and axis, said configuration including first and second generally flat, planar, truncated side walls spaced transversely and diverging from a centerline axial plane coincident with the longitudinal axis and intermediate said truncated side walls, said first and second truncated side walls in the form of a truncated isosceles triangle, each sidewall having a bottom edge and a top edge, said bottom edges forming an open third side connecting span of said truncated isosceles triangle therebetween;

a continuous cross wall of said sheet connecting the first and the second truncated side walls at their the respective top edges, said two top edges having a first dimension spacing therebetween transverse to the axial plane, said first and second truncated side walls diverging outwardly from said two top edges at an angle of at least five degrees to fifteen degrees;

said first and second truncated side walls each including a longitudinal rib extending parallel to the longitudinal axis with a top edge rib side and a bottom edge rib side parallel to the longitudinal axis, each said rib integrally formed in said sheet in each respective truncated side wall and having an equal rib width dimension measured transverse to the axis between said top edge rib side and said bottom edge rib side and a same cross sectional configuration, each said rib located intermediate a said top edge and a said bottom edge of each said truncated side wall;

each side wall further including an outwardly extending, flat planar, lateral side plate member extending from the bottom edge of said side wall, said side plate members co-planar and each said plate member extending to an outer edge, said outer edges spaced a second dimension spacing transverse to the axis whereby the second dimension spacing of said outer edges is about 1.6 times the first dimension spacing of the top edges of the first and second truncated side walls, said lateral side plate members each terminating with a longitudinal upwardly extending lip from said outer edge in a direction of the cross wall, each said lip forming an obtuse angle with a said respective lateral side plate member, the obtuse angle of the lips is in the range of 95±1 degree, said side plate members each including strut fastener openings, said cross wall configured with first and second equally configured and sized pylons, said pylons spaced by a connecting flat planar intermediate wall section, said intermediate wall section having a dimension transverse to the axial plane in the range of 60-75% of the first dimension spacing of said top edges of said truncated first and second walls, each pylon having a flat top surface section with an equal third dimension transverse to the longitudinal axial plane no more than 20% of the first dimension spacing, said pylon flat top surface sections coplanar and transverse to said axial plane, said intermediate wall section parallel to said pylon flat top surface sections and located a fourth spaced dimension intermediate the distance between the top edges of the pylons and the top side edges of the longitudinal ribs;

said rib width dimension substantially equal to the distance from the top edge rib side of each rib to the adjacent top edge of the side wall, said strut symmetrical in cross-section about said longitudinal plane and having a centroid in the range of about 35% to 45% of a dimension measured in the axial plane from the flat top surfaces of the pylons to the bottom edge of the truncated side wall; said longitudinal ribs each having said bottom edge rib side intermediate said centroid and the top surface of the pylons.

2. The improvement of claim 1 in combination with a longitudinal truss having a U shaped cross section and lateral truss side wings, said truss side wings fastened directly to the intermediate wall section of said strut between the pylons.

* * * * *